US005617646A

United States Patent [19]

Viscuso

[11] Patent Number: 5,617,646

[45] Date of Patent: Apr. 8, 1997

[54] FOOTWEAR DRYER AND CLEANER

[76] Inventor: Joseph S. Viscuso, 555 Arlington Dr., Seaford, N.Y. 11783

[21] Appl. No.: 280,396

[22] Filed: Jul. 26, 1994

[51] Int. Cl.[6] ..... F26B 19/00

[52] U.S. Cl. ..... 34/60; 34/90; 34/233; 392/380

[58] Field of Search ..... 34/104, 90, 91, 34/192, 202, 233, 225; 392/380, 384

[56] References Cited

U.S. PATENT DOCUMENTS

| | | | |
|---|---|---|---|
| 1,658,489 | 2/1928 | Lindstrom | 392/380 |
| 3,054,129 | 9/1962 | Dragoon | 34/202 |
| 3,144,675 | 8/1964 | Canaan | 34/104 |
| 4,782,601 | 11/1988 | Gonzalez | 392/380 |
| 5,283,962 | 2/1994 | Humaan | 34/202 |

*Primary Examiner*—Henry A. Bennett
*Assistant Examiner*—Susanne C. Tinker
*Attorney, Agent, or Firm*—Gennaro L. Pasquale

[57] ABSTRACT

A device for drying and cleaning footwear comprising a shallow housing on which the user steps to activate heater blowers which provide hot air which is directed upward against the footwear of the user. At the same time the user moves his feet against brushes. The debris and water falls though the device to be collected in shallow drawers at the bottom of the device.

3 Claims, 2 Drawing Sheets

FOOTWEAR DRYER AND CLEANER

FIELD OF THE INVENTION

The present invention relates to a footwear dryer and cleaner in general and more particularly to a footwear dryer and cleaner for cleaning and drying soles of shoes, boots or other footwear in bowling alleys and other places where the public may enter and which the proprietor wishes to protect from the danger, soil, wear and tear caused by individuals who enter the establishment with sand, salt, snow, water and the like on their shoes, boots or other footwear.

BACKGROUND OF THE INVENTION

When people enter bowling alleys, particularly in the winter and during inclement weather, their shoes or boots may be wet and may carry sand, salt and snow which adheres to the soles of their shoes or boots. If they do not remove this sand, salt and snow they may carry it to the lanes where it may cause a slippery condition and danger to themselves and others using the facility. While mats may be provided for customers to wipe their feet, there will always be a certain percentage of the public which will not adequately clean their shoes, boots or other footwear and who will track sand, salt, snow and moisture into the bowling alley.

SUMMARY OF THE INVENTION

In view of the foregoing factors and conditions characteristic of the prior art, it is a primary object of the present invention to provide a footwear dryer for removing sand, salt, snow, water and the like from the soles of shoes, boots or other footwear.

Another object of the present invention is to provide a footwear dryer for removing sand, salt, snow, water and the like from the soles of shoes and boots in bowling alleys and other places of public accommodation.

Another object of the present invention is to provide a sole dryer for removing sand, salt, snow, water and the like from the soles of shoes, boots or other footwear, which includes a tray for collecting debris and water which comes off the soles of shoes and boots as they are cleaned and dried.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures.

BRIEF DESCRIPTION OF TEE DRAWINGS

DETAILED DESCRIPTION OF THE DRAWINGS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 7:
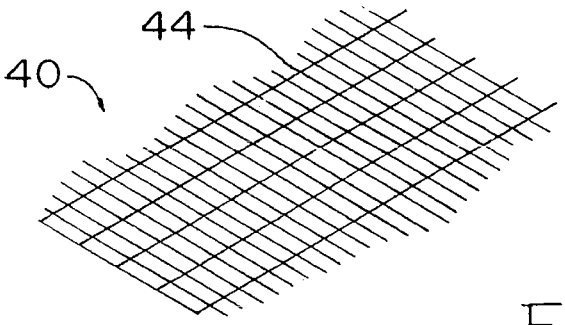
FIG. 7 is a prospective view of the vent grids of the embodiment shown in FIG. 1.

Referring now to the drawings there is shown a footwear dryer and cleaner 10 having a housing 12 which is divided into three sections 14, 16 and 18 by structural support partitions 20, 22 and 24. Sections 16 and 18 are similar. Each is open at the top and comprise an air chamber 26, a clean out drawer 28 directly below the air chamber 26 and means for attaching a grid above the chamber. Section 14 houses the mechanical, electrical and control components of the device. The leading and trailing edges 30 and 32 of the housing 12 are tapered to reduce the chance of the users tripping on the device. By placing the mechanical, electrical and control components of the device in section 14 on the side of the device I have been able to reduce the height of that part of the housing, sections 16 and 18, which the user will step on to a minimum, thereby further reducing the chance that the user will trip on the device. Rigid Support and vent grids 40 are fitted across the open tops of chambers 26. The grids 40 may be molded into the top of the housing 12 or may be removably mounted in recesses in the structural support partitions 20, 22 and 24. The support grids, which are shown in FIG. 7, consist of transverse members 44 spaced sufficiently close the each other to prevent the thin heal of a shoe to be caught and yet sufficiently far apart to not restrict the flow of air from the chambers 26. The transverse fins 44 are angled approximately 60 degrees toward the center line to direct air flowing from the chambers upward toward the users shoes or boots. the angle on the transverse fins also permits a greater spacing of the fins 44 then would otherwise be feasible if the fins 44 were vertical. Fins 46 are an integral part of the vent grid and provide strength, support and stability to the support grid structure.

Removable brush grids 50 and 52 are positioned over the support grids and include brushes 54 extending upwards and inward along the sides of the brush grids and brushes 56 extending upward from the transverse components 58 of the brush grids 50 and 52. The brush grids can be removed for cleaning or replacement.

Figure 1:
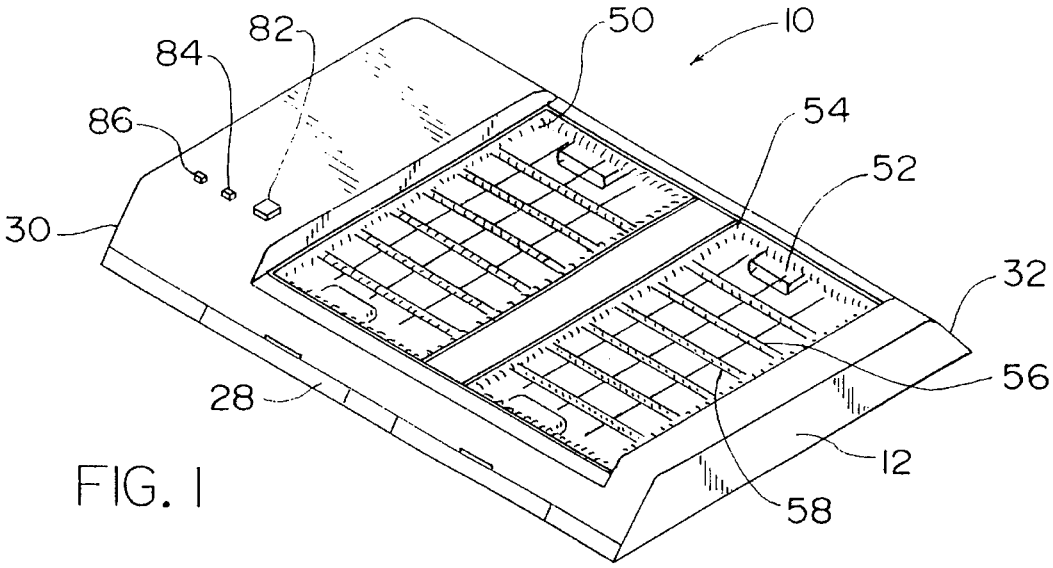
FIG. 1 Is a perspective view of one embodiment of the present invention.
Figure 2:
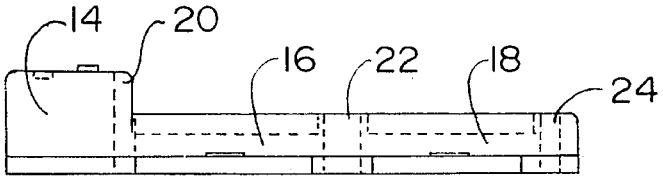
FIG. 2 Is a front view of the embodiment shown in FIG. 1.
Figure 3:
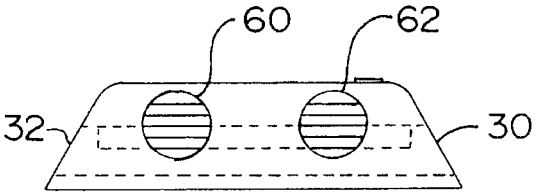
FIG. 3 is a left side view of the embodiment shown in FIG. 1.
Figure 4:
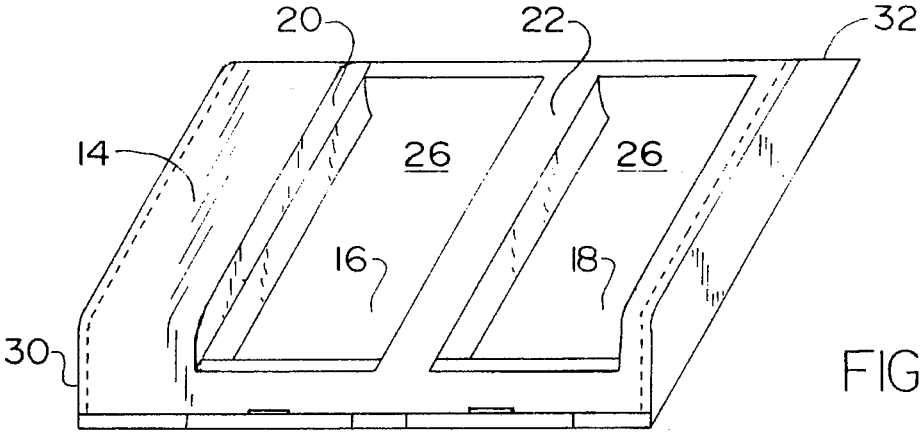
FIG. 4 is a prospective view of the base of the footwear dryer shown in FIG. 1.
Figure 5:
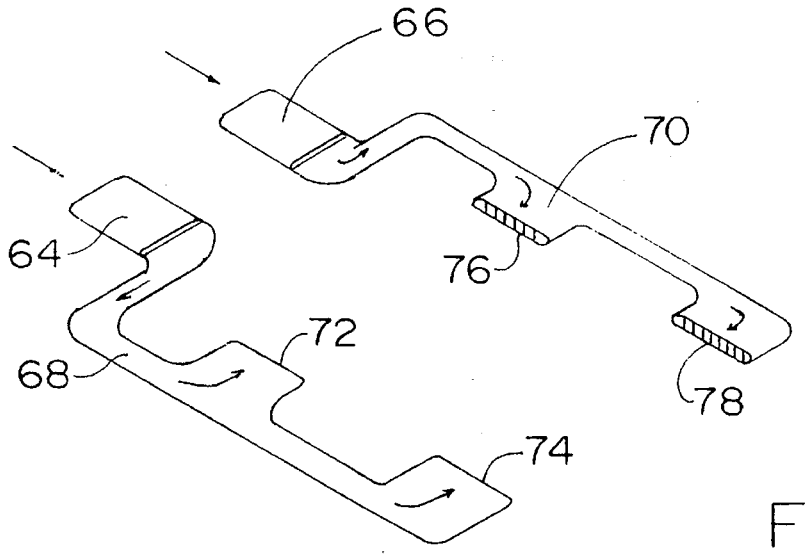
FIG. 5 is a prospective view of the air duct system of the embodiment shown in FIG. 1.

Referring to FIG. 5 there is shown the air duct system which provides warm air to the chambers 26 and which is directed upward through the grids 44 and brush grids 50 and 52. Air intakes 60 and 62 are adjacent to combination heater blowers 64 and 66 which are connected to air distribution ducts 68 and 70 terminating in outlets 72, 74, 76 and 78. Outlets 72 and 76 discharge warm air into the left air chamber 26 in section 16 while outlets 74 and 78 discharge warm air into the right air chamber 26 of section 18.

Figure 6:
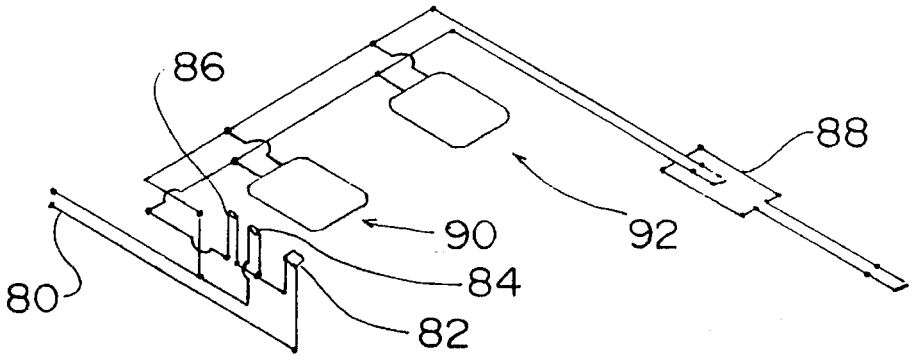
FIG. 6 is a prospective schematic view of the electrical system of the embodiment shown in FIG. 1.

Referring to FIG. 6 there is shown the electrical system for the device. The electrical system consists of a power chord 80, a foot controlled on-off switch 82, a power indicator light 84, a circuit breaker 86, micro switch 88 located under the brush grid 50 or 52 and fan-heater elements 90 and 92 which are part of the heater blowers 64 and 66.

The electric power to the machine is controlled by the switch 82 which would normally be in the on position during hours when the device is in use. When a user of the machine steps on the brush grids 50 and 52 the micro switch 88 activates the fan-heater elements in the heater blowers 64 and 66 to generate a flow of warm air which is discharged from the outlets 72, 74, 76 and 78 into the left and right chambers 26. the air flow is directed upwards and toward the center by the support vent grids 44 so that the heated air flows against the soles of the shoes or boots of the user to dry the soles. At the same time movement of the soles of the users shoes or boots against the brushes dislodges salt, mud and other debris which falls through the chambers 26 where it is collected in drawers 28. In the unlikely event of an electric overload or fault, the circuit breaker 86 will shut the machine and the power indicator light 84 will go out. The circuit breaker can be reset when the electric overload or fault has been corrected.

Typically, the machine will be placed in the path of people entering the bowling alley or other public place where the machine is being used and the user will step on the machine where he or she can clean and dry his or her boots or shoes before entering the bowling or other public area.

It is contemplated that, after having read the preceding disclosure, certain alterations and modifications of the present invention will become apparent to those of ordinary skill in the art. It is therefore intended that the following claims be interpreted to cover all such alterations and modifications as fall within the true spirit and scope of the invention.

What I claim is:

1. A footwear cleaner and dryer comprising:

a housing having a shallow air chamber therein, the air chamber being open at top;

an open support grating across the opening at the top of the air chamber and supported by said housing;

a open grating of brushes across the openings at the top of air chambers and supported by said housing, the brushes having short bristles orientated in a generally upward direction;

a shallow drawer at the bottom of the chamber in the housing;

means for directing warm air into the chamber and upwardly though the open grating comprising;

an electric air heater and blower in the housing, said air heater and blower being on one side of the shallow air chamber;

duct means for conducting air from the outlet of the electric air heater and blower into the shallow air chamber;

a trigger switch connecting the electric air heater and blower to an electric power source, the trigger switch being closeable in response to weight of a person standing on the open grating.

2. A sole cleaner and dryer comprising:

a housing having two shallow air chambers therein, the air chambers being open at top, separated from each other by a vertical wall and substantially the same size;

an open support grating across the opening at the top of each air chamber and supported by said housing;

a open grating of brushes across the openings at the top of air chambers and supported by said housing, the brushes having short bristles orientated in a generally upward direction;

a shallow drawer at the bottom of each chamber adopted to catch debris falling through the chamber;

means for directing warm air into the chambers and upwardly though the open gratings comprising;

an electric air heater and blower in the housing, said air heater and blower being on one side of the shallow air chambers;

duct means for conducting air from the outlet of the electric air heater and blower to the chambers, the duct means terminating along the perimeter of the chambers;

a trigger switch connecting the electric air heater and blower to an electric power source, the trigger switch being closeable in response to weight of a person standing on the grating.

3. A footwear cleaner and dryer comprising:

A housing having two air chambers therein of substantially equal size, each air chamber being open at top, separated from the other by a vertical wall and substantially the same size;

an open support grating of brushes across the openings at the top of air chambers and supported by said housing, the brushes having short bristles orientated in a generally upward direction;

a shallow drawer at the bottom of each chamber in the housing adopted to catch debris falling through the chamber;

means for directing warm air into the chambers and upwardly though the open grating comprising;

at least one electric air heater and blower in the housing;

duct means for conducting air from the outlet of the electric air heater and blower into said chambers, said duct means terminating along the perimeter of said chambers; and a trigger switch connecting the electric air heater and blower to an electric power source, the trigger switch being closeable in response to weight of a person standing on the open grating.

* * * * *